US010299566B2

(12) United States Patent
Schreiber et al.

(10) Patent No.: US 10,299,566 B2
(45) Date of Patent: May 28, 2019

(54) COSMETIC PRODUCT APPLICATOR AND ASSOCIATED APPLICATOR ASSEMBLY

(71) Applicant: ALBEA SERVICES, Gennevilliers (FR)

(72) Inventors: Camille Schreiber, Paris (FR); Yann Crapet, Pontoise (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 15/218,374

(22) Filed: Jul. 25, 2016

(65) Prior Publication Data

US 2017/0027304 A1 Feb. 2, 2017

(30) Foreign Application Priority Data

Jul. 27, 2015 (FR) ..... 15 57147

(51) Int. Cl.

| | |
|---|---|
| ***A45D 34/00*** | (2006.01) |
| ***A45D 40/26*** | (2006.01) |
| ***A46B 9/02*** | (2006.01) |
| ***A46D 1/00*** | (2006.01) |
| ***A46B 3/18*** | (2006.01) |
| ***A46B 11/00*** | (2006.01) |

(52) U.S. Cl.

CPC ..... *A45D 40/267* (2013.01); *A45D 40/262* (2013.01); *A46B 3/18* (2013.01); *A46B 9/021* (2013.01); *A46B 11/00* (2013.01); *A46D 1/0253* (2013.01); *A45D 34/00* (2013.01); *A46B 2200/1053* (2013.01)

(58) Field of Classification Search

CPC ..... A45D 34/045; A45D 34/046

USPC ..... 401/121, 122, 123, 126

See application file for complete search history.

(56) References Cited

U.S. PATENT DOCUMENTS

| | | | | |
|---|---|---|---|---|
| 8,191,559 | B2 * | 6/2012 | Bickford | A45D 34/045 132/218 |
| 2011/0229246 | A1 * | 9/2011 | Kulik | A45D 40/262 401/129 |

(Continued)

FOREIGN PATENT DOCUMENTS

| | | | |
|---|---|---|---|
| DE | 202013105086 | U1 | 11/2013 |
| EP | 1872682 | A1 | 1/2008 |

(Continued)

OTHER PUBLICATIONS

Jun. 13, 2016—(FR) Search Report—App. 1557147.

*Primary Examiner* — David Walczak
*Assistant Examiner* — Joshua Wiljanen
(74) *Attorney, Agent, or Firm* — Banner & Witcoff, Ltd.

(57) ABSTRACT

An applicator (10) for a cosmetic product has a core (12) and protrusions (20) projecting from the core (12). Each protrusion (20) has a reservoir (21) for the cosmetic product, and a articulation (22) of the reservoir (21) on the core (12). The articulation (22) formed by a narrowed portion. The reservoir (21) extends from the articulation (22) transversely to the articulation (22) and on either side of the articulation (22). An assembly has a receptacle having a body which forms a container intended to hold the cosmetic product. An applicator assembly has a wiper capable of scraping off excess product when the applicator (10) moves from inside the container to outside the container.

15 Claims, 5 Drawing Sheets

(56) References Cited

U.S. PATENT DOCUMENTS

| | | | | |
|---|---|---|---|---|
| 2012/0170965 | A1* | 7/2012 | Kulik | A46B 9/021 401/121 |
| 2017/0000242 | A1 | 1/2017 | Jacob et al. | |
| 2018/0242714 | A1 | 8/2018 | De Bardonneche | |

FOREIGN PATENT DOCUMENTS

| | | | |
|---|---|---|---|
| WO | 2010013213 | A2 | 2/2010 |
| WO | 2011013098 | A1 | 2/2011 |
| WO | 2016135423 | A1 | 9/2016 |
| WO | 2017003506 | A1 | 1/2017 |

* cited by examiner

COSMETIC PRODUCT APPLICATOR AND ASSOCIATED APPLICATOR ASSEMBLY

CROSS-REFERENCE TO RELATED APPLICATIONS

The present application claims priority to French Patent Application No. 1557147 filed Jul. 27, 2015. The present application claims priority to and the benefit the above-identified application, which is incorporated by reference herein in its entirety.

FIELD OF THE INVENTION

The invention relates to a cosmetic product applicator and to an associated applicator assembly.

BACKGROUND

Said applicators are commonly known as mascara brushes. They can be obtained from fibrous elements held between the longitudinal portions of a twisted metal pin, in which case they are commonly referred to as "twisted brushes". They can also be formed by injection-moulding plastics material, in which case they are commonly known as "plastics brushes".

SUMMARY

An object of the present invention is to provide an applicator that loads a greater amount of cosmetic product on the lashes to which the product is to be applied. An aspect of the invention thus relates to a cosmetic product applicator, comprising a core and protrusions projecting from the core.

According to aspects of the invention, each protrusion comprises a reservoir for said cosmetic product, and an articulation of said reservoir on said core, said articulation being formed by a narrowed portion, said reservoir extending from said articulation, transversely to said articulation and on either side of said articulation.

An advantage of the reservoirs is their capacity for holding cosmetic product. Therefore, the applicator of the invention comprises areas capable of providing a substantial amount of cosmetic product, and of doing so as closely as possible to the lashes to which the product is to be applied. The applicator of the invention thus allows a greater amount of product to be loaded on said lashes.

Moreover, the articulation of each reservoir gives it flexibility with respect to the core, which allows the reservoir to adapt to the lashes to which the product is to be applied.

According to different embodiments of the invention, which may be taken together or separately:

- said reservoir is in the form of a concave cup,
- said core has a main longitudinal extension direction, referred to as the main direction,
- said cup makes a continuous, curved line in a plane that passes through said main direction, said curved line having a single apex and two free ends, which are located on either side of said apex,
- said reservoir has an extension direction and two opposite ends in said extension direction, one and/or the other of said ends being oriented in a direction secant to said main direction (X), in particular transversely to said main direction (X), so as to provide a styling effect,

- said articulation is connected to the reservoir in a region between the centre of said reservoir and one of the ends thereof,
- said protrusions are arranged in rows parallel to said main direction,
- said reservoir is oriented asymmetrically with respect to said articulation, such that one of the ends of the reservoir is oriented substantially along the main direction,
- the successive rows of protrusions are staggered with respect to one another,
- all the protrusions of one row have a reservoir oriented asymmetrically with respect to said articulation, such that a first end of the ends of the reservoir is oriented substantially along the main direction and such that the second end of the ends of the reservoir is oriented along a direction secant to said main direction, in particular transversely to said main direction, so as to create areas in which the first end of one protrusion is in substantially the same plane as the second end of an adjacent protrusion of the same row,
- the narrowed portion of each protrusion is designed to ensure that the corresponding reservoir has a degree of rotational freedom with respect to the core, in particular forming a pivot connection with respect to the core,
- the applicator of the invention further comprises two opposite distal ends along the main direction, at least one of said ends being free,
- the applicator of the invention further comprises, in the region of said free distal end, a plurality of teeth projecting from the core in a radial direction with respect to said main direction,
- the applicator of the invention further comprises at least one row of teeth,
- said row of teeth is arranged in parallel with said main direction, between two of said rows of protrusions,
- the protrusions and/or teeth each have a planar surface,
- the protrusions and/or teeth are positioned such that the planar surfaces of two adjacent protrusions and/or teeth are oriented in the same rotational direction,
- the rows of protrusions or teeth extend over the entire periphery of the core,
- said rows of protrusions or teeth are radially spaced around the periphery of the core at a constant angular distance,
- the core has a constant cross section from the proximal end to the distal end,
- the core is solid,
- the core is made of plastics material,
- the protrusions or teeth are made of plastics material,
- the core and the protrusions or teeth are moulded together, in particular from the same material,
- the protrusions or the teeth are overmoulded onto the core,
- the applicator forms a brush.

Aspects of the invention also relate to a cosmetic product applicator assembly, comprising a receptacle having a body which forms a container intended to hold the cosmetic product, and an applicator as described above that can be attached to the receptacle such that the applicator is housed within the container.

Aspects of the invention also relate to an applicator assembly of this type that further comprises a wiper capable of scraping off excess product when the applicator moves from inside the container to outside the container, the applicator being designed such that a plurality of said protrusions are tilted as they pass through said wiper so that the cosmetic product that can be held by the reservoirs on said protrusions is lightly wiped off.

BRIEF DESCRIPTION OF THE DRAWINGS

The invention will be better understood, and its other aims, details, features and advantages will become more apparent in the following detailed explanatory description of at least one embodiment of the invention given as a purely illustrative and non-limiting example, with reference to the accompanying schematic drawings, in which.

DETAILED DESCRIPTION OF EXEMPLARY ASPECTS

Figure 1:
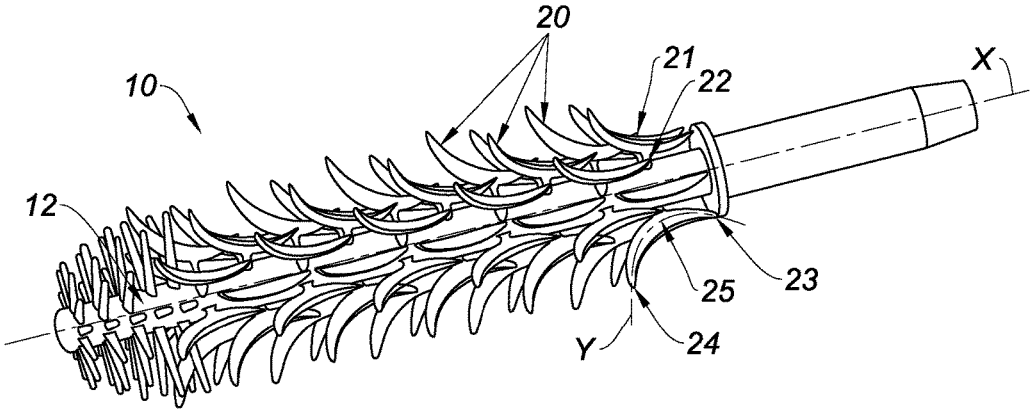
FIG. 1 is an isometric, slightly tilted view of a first embodiment of an applicator according to the invention, viewed from a first point of view.

As shown in the drawings, the invention relates to a cosmetic product applicator 10, comprising a core 12 and protrusions 20 projecting from the core 12, said core 12 having a main longitudinal extension direction, referred to as the main direction and labelled X in the drawings.

According to aspects of the invention, each protrusion 20 comprises a reservoir 21 for said cosmetic product. A reservoir 21 is understood to be a shaping that can be loaded with and/or hold cosmetic product, in particular when said applicator 10, and thus the protrusions 20 thereon, are wiped. Said reservoir 21 forms a cup; when said reservoir 21 is viewed from the side, its shape can be compared to that of a croissant or a banana.

Figure 8:
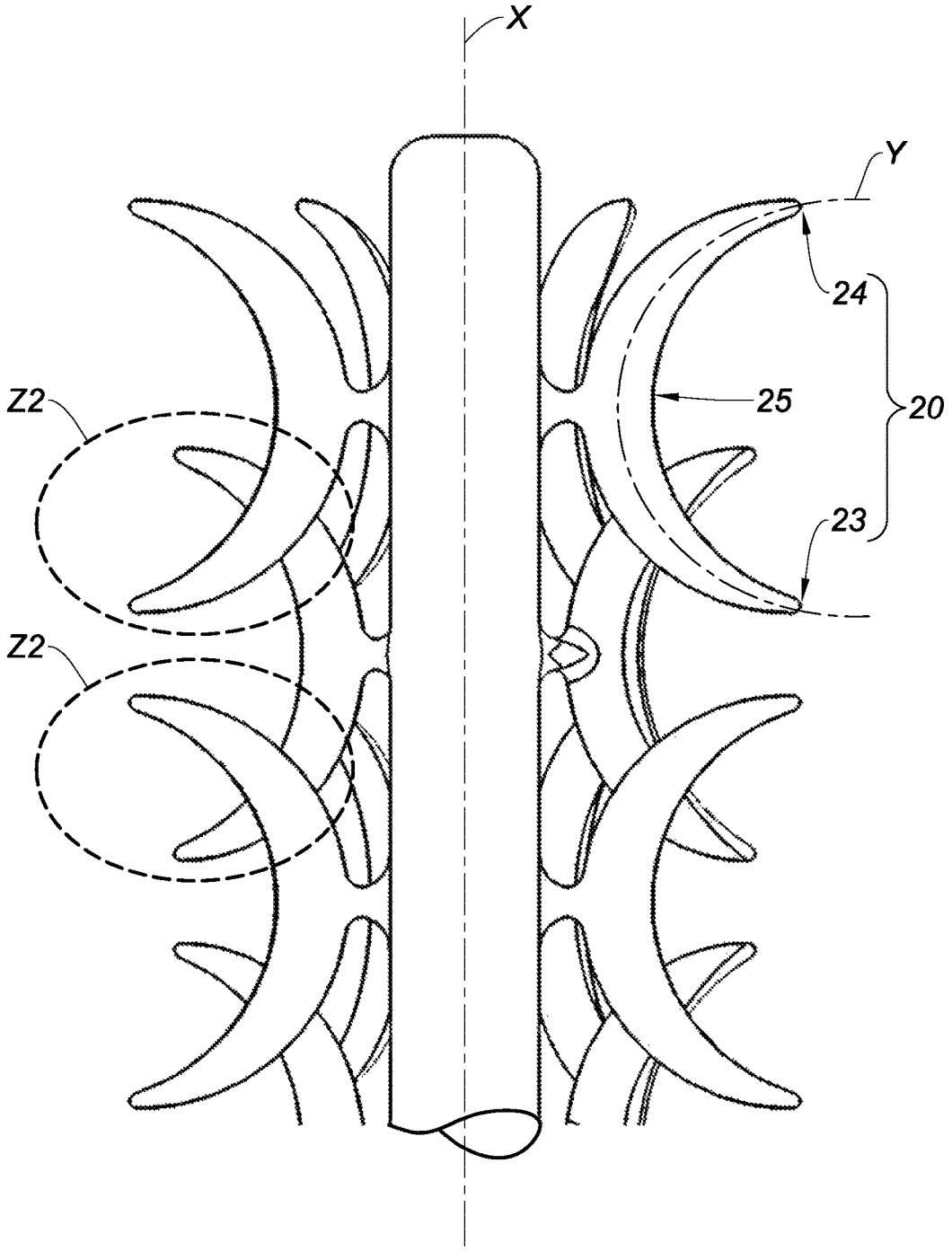
FIG. 8 is an illustration showing just one portion of the length of a fourth embodiment of an applicator according to the invention.

In other words, said reservoir 21 is in the shape of a concave cup, which makes a continuous curved line in a plane that passes through said main direction X. This line is labelled Y in FIGS. 1 and 8. Said curved line Y has a single apex 25 and two free ends 23, 24, which are located on either side of said apex 25 (see also FIG. 4).

Put another way, said reservoir 21 has an extension direction Y and two opposite ends 23, 24 in said extension direction Y. The extension provided in this direction Y, and more specifically the curvature provided in this extension direction Y, is intended to give said reservoir 21 its storage capacity.

According to aspects of the invention, each protrusion 20 also comprises an articulation 22 of said reservoir 21 with respect to said core 12, said articulation 22 being formed by a narrowed portion. The narrowed portion is understood to be a leg portion for the reservoir 21. In other words, the narrowed portion is a portion that extends radially from the periphery of the core 12. Put another way, the narrowed portion 22 acts a support or base for the reservoir 21; said narrowed portion is located between the core 12 and the outer, convex portion of the reservoir 21 (see FIGS. 1 and 4).

Moreover, as shown in the drawings, said reservoir 21 extends from said articulation 22, transversely to said articulation 22 and on either side of said articulation 22. The articulation allows the reservoir 21 to be movable by several angular degrees relative to the periphery of the core 12. Said reservoir 21 can thus bend about an axis that is transverse to both said main direction X and the radial extension direction of the leg 22.

In other words, the narrowed portion 22 of each protrusion 20 is designed to ensure that the corresponding reservoir 21 has a pivot connection with respect to the core 12, at least in a plane that is orthogonal to both said main direction X and the radial extension direction of the narrowed portion 22.

This pivot connection is not limiting, and said reservoir 21 joined thus on a leg can have other degrees of freedom, in particular a degree of rotational freedom about the radial extension direction of the narrowed portion 22. This is understood to mean that the articulation 22 can undergo twisting about its axis of extension, in particular by several angular degrees, without breaking.

Put another way, said articulation 22 is a ball articulation.

Said articulation 22 is advantageously connected to the reservoir 21 in a region between the centre of said reservoir 21 and one of the ends 23, 24 thereof, in particular by means of the outer, convex part thereof.

Moreover, the ends 23, 24 of said protrusions 20 give a general impression of a jacket for the applicator 10, and it is worth noting that the orientation of the reservoir 21 in relation to its articulation 22 allows at least one of the ends 23, 24 to protrude out such that said end is used to separate the lashes, and so is used to style/comb said eyelashes.

An "end" is understood to be a collection of points or even an area of the reservoir 21. In other words, an end 23, 24 is not formed by the single end point of said reservoir 21 along the axis Y, but rather by all the points that define a tip/a comb tooth that can be used to separate lashes.

An orientation of the reservoir 21 with respect to the main direction X thus allows the applicator 10 of the invention to be given advantageous styling effects.

Figure 2:
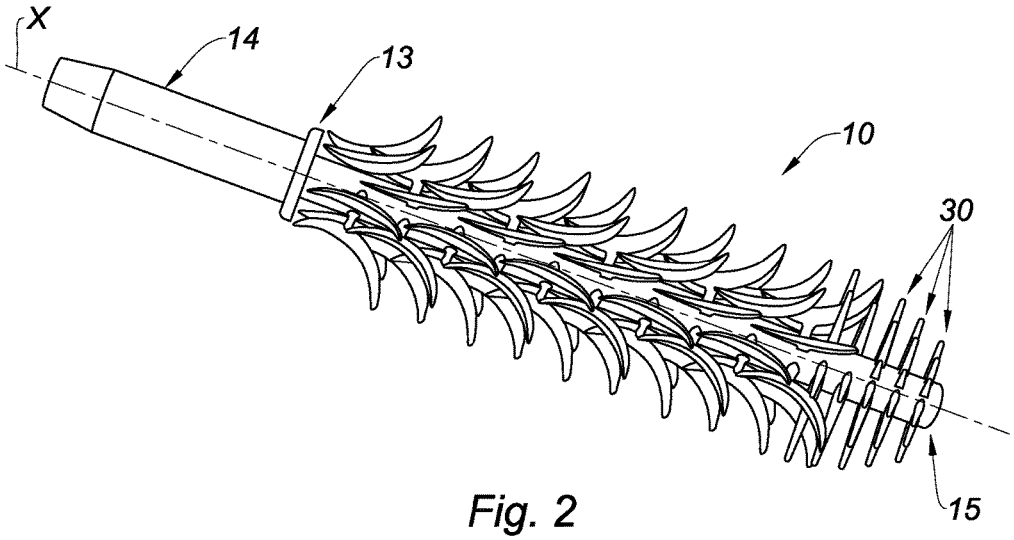
FIG. 2 shows the applicator of FIG. 1 from a different point of view.

FIGS. 1 and 2 show a first embodiment in which the ends 24 of the reservoirs 21 are oriented transversely to said main direction X, substantially along normals to said main direction X. This orientation has the advantage of allowing said ends 24 to pass through the lashes to be combed, while these lashes are being loaded with cosmetic product loaded in the reservoirs 21.

Figure 3:
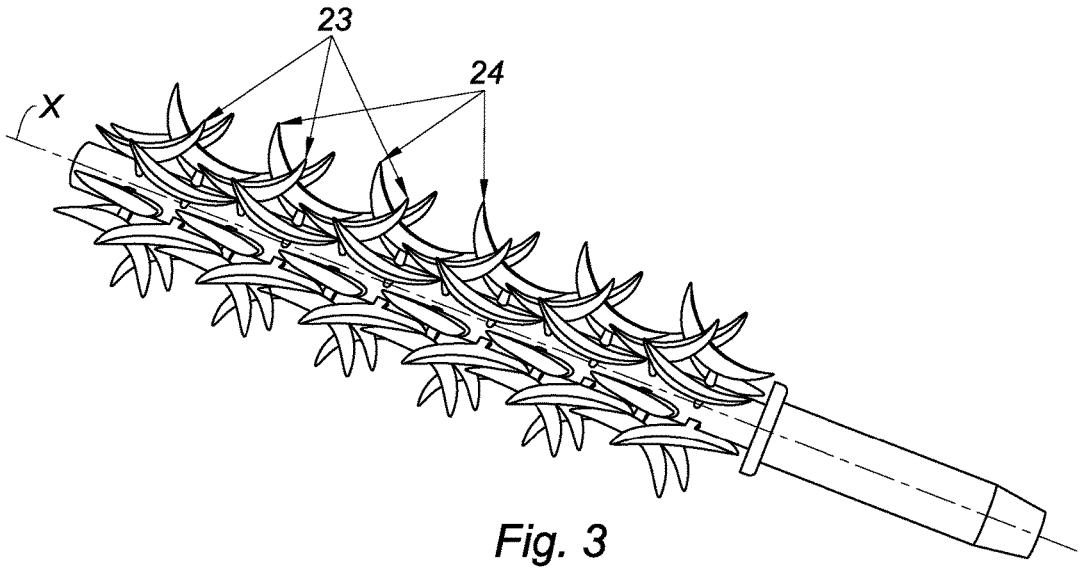
FIG. 3 is an isometric, slightly tilted view of a second embodiment of an applicator according to the invention.
Figure 4:
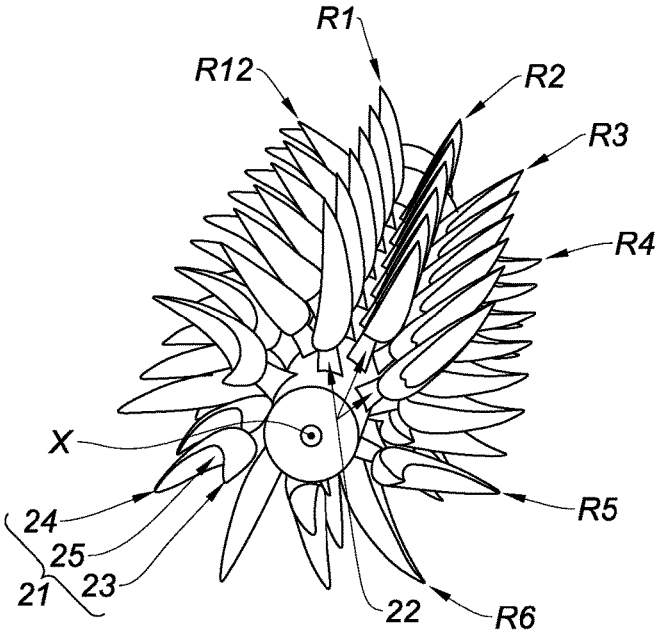
FIG. 4 is an isometric view, substantially from the top, of the applicator of FIG. 3.
Figure 5:
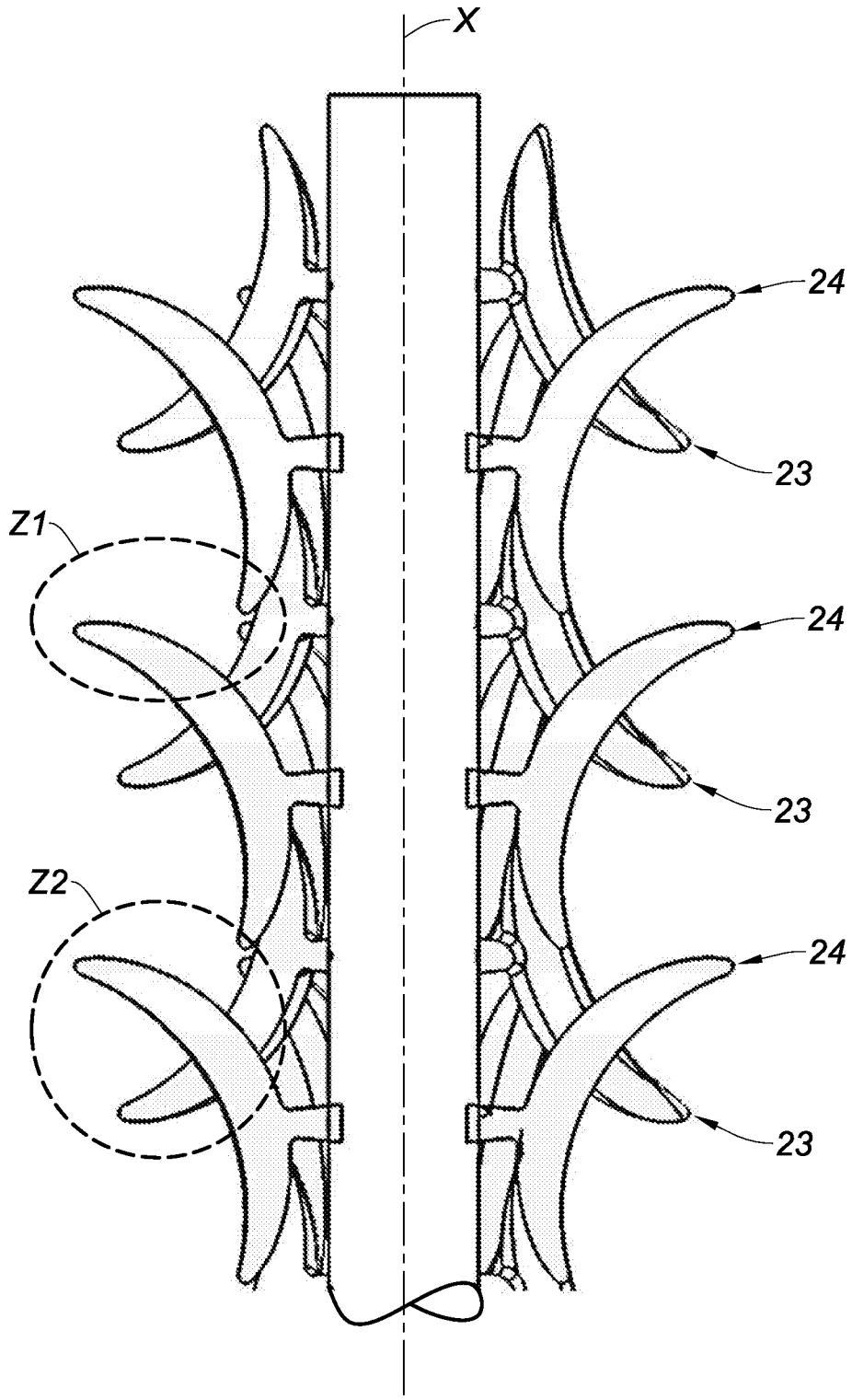
FIG. 5 is an illustration showing just one portion of the length of the applicator of FIG. 3.

FIGS. 3, 4 and 5 show a second embodiment, in which the ends 23, 24 of the reservoirs 21 are oriented in an alternating manner transversely to said main direction X, substantially along normals to said main direction X. In other words, the protrusions 20 are arranged in rows R1-R12 parallel to said main direction X, and a first of said parallel rows has reservoirs 21 of which the end 23 is oriented transversely to said main direction X, substantially along normals to said main direction X, whereas the adjacent parallel rows have reservoirs 21 of which it is the end 24, which is opposite the end 23 in its extension direction Y, that is oriented transversely to said main direction X. This alternation of the ends 23, 24 protruding from the jacket of the applicator 10 has the advantage of further optimising the penetration of said ends 23, 24 into the lashes to be combed, while these lashes are being loaded with cosmetic product held in the reservoirs 21.

It should be noted that in this embodiment all the protrusions 20 of one row R12-R12 have a reservoir 21 oriented asymmetrically with respect to said articulation 22, such that a first end 23 of the ends 23, 24 of the reservoir 21 is oriented substantially in the main direction X and such that the second end 24 of the ends 23, 24 of the reservoir 21 is oriented in a direction secant to said main direction X, in particular transversely to said main direction X, so as to create areas Z1 in which the first end 23 of one protrusion 20 is substantially in the same plane as the second end 24 of a protrusion adjacent to a same row R1-R12 (see FIG. 5). This orientation allows a higher number of protrusions 20 to be provided within one row R1-R12 because the longitudinal spread, measured in particular in said main direction X, can then be reduced, zero, or even negative.

It should also be noted that this alternation of the ends 23, 24 that protrude from the jacket of the applicator 10 define areas Z2 (see FIG. 5) that act as traps for the lashes, in particular such as to better stretch/comb/curl said eyelashes once at said area Z2.

It should also be noted that the distribution of the protrusions 20 in rows parallel to the main direction X is not limited to the second embodiment shown in FIGS. 3, 4 and 5.

It should also be noted that the invention also relates to a cosmetic product applicator assembly, comprising a receptacle comprising a body which forms a container (not shown here) intended to hold the cosmetic product, and an applicator 10 as described above that can be attached to the receptacle such that the applicator 10 is housed within the container.

Aspects of the invention also relate to an applicator assembly of this kind that further comprises a wiper (not shown here) capable of scraping off excess product when the applicator 10 moves from inside the container to outside the container. The applicator 10 is designed such that a plurality of said protrusions 20 are tilted as they pass through said wiper such that the cosmetic product that can be held by the reservoirs 21 on said protrusions is lightly wiped off.

Figure 6:
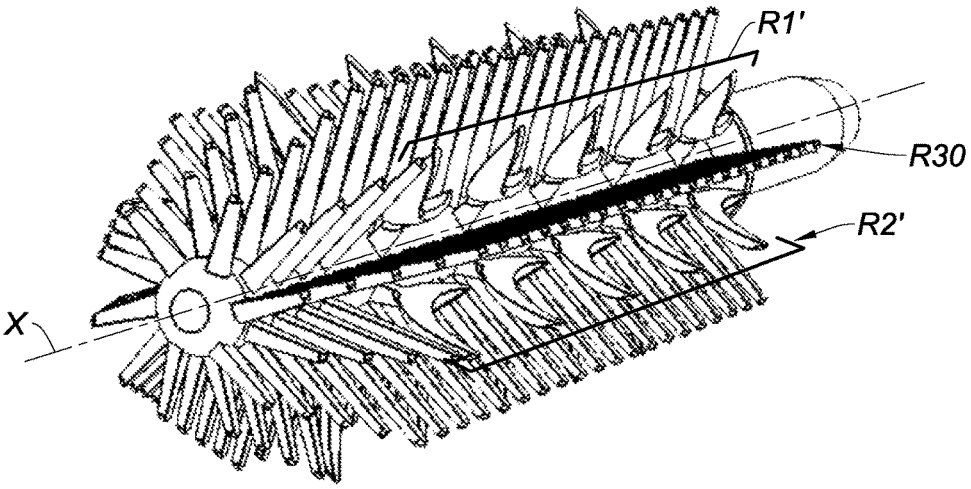
FIG. 6 is an isometric, slightly tilted view of a third embodiment of an applicator according to the invention.
Figure 7:
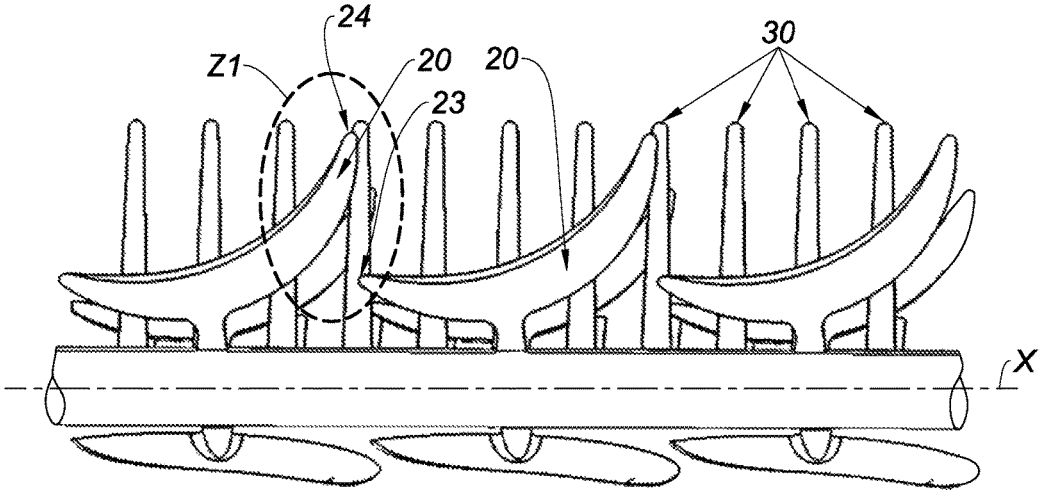
FIG. 7 is an illustration showing just one portion of the length of the applicator of FIG. 6.

In the first (FIGS. 1 and 2), the second (FIGS. 3, 4 and 5) and third (FIGS. 6 and 7) embodiments, the wiping obtained at the protrusions 20 will not be uniform.

The reservoirs 21 can thus be oriented asymmetrically with respect to said articulation 22, so as to obtain the styling effect described above, and/or such that one of the ends 23, 24 of the reservoir 21 is tangential to the main direction X. It is this tangential orientation of one of said ends 23, 24 that, inter alia, allows the protrusions 20 to pass through said wiper.

The fourth embodiment (shown in FIG. 8) has protrusions 20 that each have a reservoir 21 oriented substantially symmetrically to their articulation 22, such that the two ends 23, 24 of the reservoir 21 are oriented substantially in a direction secant to said main direction X, in particular transversely to said main direction X, so as to create a greater number of areas Z2 between the protrusions 20 of adjacent, staggered rows than in the first, second and fourth embodiments described above.

In the first (FIGS. 1 and 2), second (FIGS. 3, 4 and 5) and fourth (FIG. 8) embodiments, the successive rows R1-R12 of protrusions 20 are staggered with respect to one another. This can be seen in particular in FIGS. 4, 5 and 8, which show the second and fourth embodiments. This staggering is advantageous in that the ends 23, 24 for styling/combing the eyelashes are offset between two successive rows.

In other words, this has the added advantage that the ends 23, 24 or tips 23, 24 are better distributed in the main direction X, but also around the periphery of the core 12. Put another way, this staggering allows the usable ends 23, 24 to be increased for separating the lashes.

The applicator 10 further comprises two distal ends 13, 15, which are opposite one another along said main direction X, at least one 15 of said ends being free. In the first (FIGS. 1 and 2) and third (FIG. 6) embodiment, the applicator 10 further comprises, in the region of said free distal end 15, a plurality of teeth 30 projecting from the core 12, in particular in a radial direction with respect to the main direction X, or even along normals to the periphery of the core 12. Said teeth 30 make it possible to use the applicator 10 for precise application of make-up, for example to apply cosmetic product to hard-to-access eyelashes, in particular in the corners of a user's eyes.

In the third embodiment (FIG. 6), the applicator 10 further comprises at least one row of teeth 30, arranged in parallel with said main direction X, between two of said rows R1', R2' of protrusions 20. This configuration further improves the styling/combing capabilities of the applicator 10 of the invention.

It should be noted that the protrusions 20 and/or the teeth 30 each have a planar surface. This is advantageous in that moulding thereof is simplified.

In addition and also with a view to simplifying the moulding, said protrusions 20 and/or the teeth 30 are positioned such that the planar surfaces of two adjacent protrusions 20 and/or teeth 30 are oriented in the same direction of rotation.

To ensure complete application of the cosmetic product to a user's eyelashes, the rows R1-R12 of protrusions 20 or teeth 30 advantageously extends over the entire periphery of the core 12.

As can be seen in FIG. 4, said rows R1-R12 of protrusions 20 or teeth 30 are advantageously radially spaced around the periphery of the core at a constant angular distance, for example an angular distance of between 15° and 45°, preferably an angular distance of 30° in this case.

On the other hand, to provide the core 12 of the applicator 10 with a certain degree of stiffness, the core 12 is provided having a constant, and in particular solid, cross section from the proximal end 13 to the distal end 15.

The material selected for the protrusions 20 is a plastics material, in particular because this makes it easier to produce the substantially complex shapes intended for said protrusions 20, in particular by moulding.

The teeth 30 are also made of plastics material, just like the core 12.

On the other hand, the core 12 and the protrusions 20 or teeth 30 are advantageously moulded together, in particular from the same material.

The protrusions 20 or teeth 30 can also be overmoulded onto said core 12 (see the second embodiment shown in FIGS. 3 and 4). Overmoulding the protrusions 20 or teeth 30 is advantageous in that the protrusions 20, and in particular the articulations 22 of said protrusions 20, can be made from a material having a greater resilient strength, in particular to prevent said protrusions breaking off, for example when they pass through the aforementioned wiper.

The core 12 and the protrusions 20 and/or teeth 30 can thus be moulded from a material based on LDPE (low-density polyethylene). Other materials can also be used, namely the material "EXACT" from ExxonMobil or the material "HYTREL" from Dupont, or a mixture of these materials.

It should also be noted that the applicator 10 forms a brush, in particular fitted with a cylindrical coupling 14 that extends in said main direction X from said proximal end 13, said cylindrical coupling 14 being designed to interact with a rod (not shown here) intended to be incorporated in a cap (not shown here) for the aforementioned receptacle.

Equally, it should be noted that the invention is not limited to the embodiments described, and that the features of said embodiments can be combined, without departing from the scope of the invention, in order to combine the make-up effects or to obtain new ones.

It should also be noted that variants are of course possible. In particular, it is also conceivable, in an embodiment not shown here, for the periphery of the core 12 to comprise rows of protrusions 20 over a first angular portion, for example 180°, and to comprise, over the remaining angular portion, rows having other patterns that are also involved in applying the cosmetic product to a user's eyelashes.

The invention claimed is:

1. Cosmetic product applicator comprising a core and protrusions projecting from the core, each protrusion comprising a reservoir for said cosmetic product and an articulation of said reservoir on said core, said articulation being formed by a narrowed portion, said reservoir extending from said articulation, transversely to said articulation and on either side of said articulation;

wherein said core has a main longitudinal extension direction, referred to as the main direction (X), said reservoir having an extension direction (Y) and two opposite ends along said extension direction (Y), one and/or the other of said ends being oriented in a direction secant to said main direction (X) so as to produce a styling effect;

wherein said reservoir is oriented asymmetrically with respect to said articulation, such that one of the ends of the reservoir is oriented substantially along the main direction (X).

2. Applicator according to claim 1, wherein said reservoir is in the form of a concave cup.

3. Applicator according to claim 1, wherein one and/or the other of said ends being oriented in a direction transversely to said main direction (X).

4. Applicator according to claim 1, wherein said articulation is connected to the reservoir in a region between the centre of said reservoir and one of the ends thereof.

5. Applicator according to claim 1, wherein said protrusions are arranged in rows parallel to said main direction (X).

6. Applicator according to claim 1, wherein all the protrusions of a same row have a reservoir oriented asymmetrically with respect to said articulation, such that a first end of the ends of the reservoir is oriented substantially along the main direction (X) and such that the second end of the ends of the reservoir is oriented in a direction secant to said main direction (X), in particular transversely to said main direction (X), so as to create areas (Z1) in which the first end of a protrusion is substantially in the same plane as the second end of an adjacent protrusion of a same row.

7. Applicator according to claim 1, wherein the successive rows of protrusions are staggered with respect to one another.

8. Applicator according to claim 7, wherein a first row of said rows comprises protrusions of which the first of said two ends is oriented in a direction secant to said main direction (X), in particular transversely to said main direction (X), and wherein a row adjacent to said first row comprises protrusions of which the second of said two ends is oriented in a direction secant to said main direction, in particular transversely to said main direction (X), said ends of the protrusions of said first row and second row forming areas therebetween so as to produce a styling effect.

9. Applicator according to claim 1, wherein the narrowed portion of each protrusion is designed such as to ensure that the corresponding reservoir has a degree of rotational freedom with respect to the core, in particular forming a pivot connection with respect to the core.

10. Applicator according to claim 1, further comprising two opposite distal ends along said main direction (X), at least one of said distal ends being free, said applicator further comprising, in the region of said free distal end, a plurality of teeth projecting from the core in a radial direction with respect to said main direction (X).

11. Applicator according to claim 1, further comprising at least one row of teeth, said row of teeth being arranged in parallel with said main direction (X), between two of said rows of protrusions.

12. Applicator according to claim 1, wherein the protrusions each have a planar surface.

13. Applicator according to claim 12, wherein the protrusions are positioned such that planar surfaces of two adjacent protrusions are oriented in the same rotational direction.

14. Cosmetic product applicator assembly, comprising:

a receptacle comprising a body which forms a container intended to hold the cosmetic product, and an applicator according to claim 1 that can be attached to the receptacle such that the applicator is housed within the container.

15. Applicator assembly according to claim 14, further comprising a wiper capable of scraping off excess product when the applicator moves from inside the container to outside the container, the applicator being designed such that a plurality of said protrusions are inclined as they pass through said wiper such that the cosmetic product that can be held by the reservoirs on said protrusions is lightly wiped off.

* * * * *